US006640478B2

(12) United States Patent
Johansson

(10) Patent No.: US 6,640,478 B2
(45) Date of Patent: Nov. 4, 2003

(54) FIRING MECHANISM AT FIREARMS

(76) Inventor: Bertil Johansson, Vickavägen 109, S-439 30 Onsala (SE)

( * ) Notice: Subject to any disclaimer, the term of this patent is extended or adjusted under 35 U.S.C. 154(b) by 0 days.

(21) Appl. No.: 10/034,282

(22) Filed: Dec. 28, 2001

(65) Prior Publication Data

US 2002/0053155 A1 May 9, 2002

Related U.S. Application Data

(63) Continuation of application No. PCT/SE00/01377, filed on Jun. 28, 2000.

(30) Foreign Application Priority Data

Jun. 28, 1999 (SE) ..... 9902427-5

(51) Int. Cl.[7] ..... F41A 19/12
(52) U.S. Cl. ..... 42/69.02; 42/70.05; 89/136
(58) Field of Search ..... 42/69.02, 70.05; 89/136, 148

(56) References Cited

U.S. PATENT DOCUMENTS

| | | | | |
|---|---|---|---|---|
| 2,367,280 A | | 1/1945 | Hyde | |
| 2,370,435 A | | 2/1945 | Wurzer | |
| 3,735,519 A | * | 5/1973 | Fox | |
| 3,950,876 A | * | 4/1976 | Wild et al. | 42/69.02 |
| 4,058,924 A | * | 11/1977 | Mullner | |
| 4,512,236 A | | 4/1985 | Thevis et al. | 89/128 |
| 4,662,098 A | * | 5/1987 | Timari | 42/69.01 |
| 4,908,970 A | * | 3/1990 | Bell | 42/69.02 |
| 5,487,233 A | * | 1/1996 | Jewell | 42/69.01 |
| 5,615,507 A | * | 4/1997 | French | 42/69.02 |

FOREIGN PATENT DOCUMENTS

| | | | | |
|---|---|---|---|---|
| DE | 1 287 972 | * | 1/1969 | 42/69.02 |
| DE | 2 253 199 | * | 3/1974 | 42/69.02 |
| GB | 1410023 | | 10/1975 | |
| GB | 2032589 A | | 5/1980 | |

* cited by examiner

*Primary Examiner*—Stephen M. Johnson
(74) *Attorney, Agent, or Firm*—Samuels, Gauthier & Stevens, LLP

(57) ABSTRACT

A firing mechanism for firearms, in particular a firing mechanism for automatic firearms, without preadjustmnent with regard to the choice of firing single rounds or bursts of fire, whereby a firing link provided with firing edge and arranged around a rotational axis, a lever arm being able to become influenced by the firing edge, which lever arm is present in a spring joint with a lever link, whereby said lever link is present in a spring joint in relation to a sear which carries one or more holding teeth for a bolt, whereby the lever arm/lever link are arranged around a further rotation axis.

9 Claims, 6 Drawing Sheets

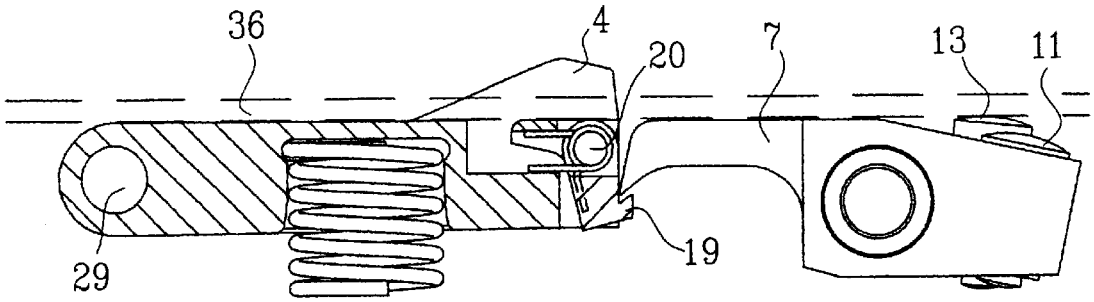
FIG.11/1
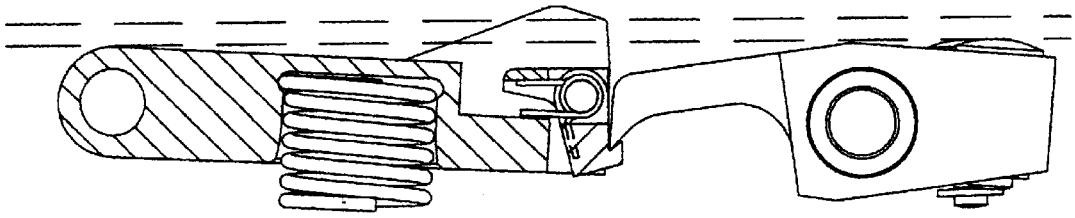
FIG.11/2
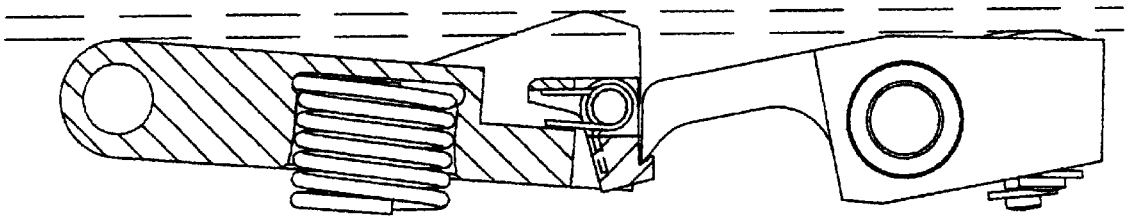
FIG.11/3
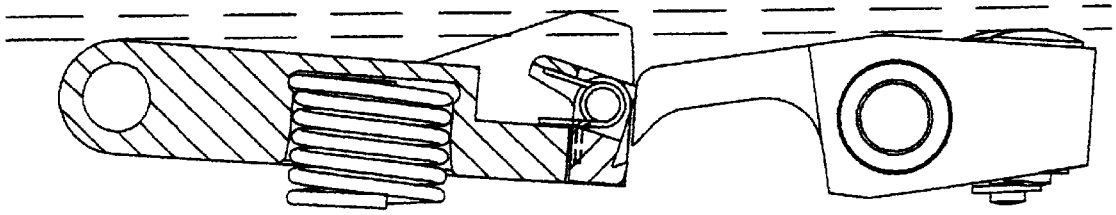
FIG.11/4

FIRING MECHANISM AT FIREARMS

This a continuation of applicaton No. PCT/SE00/01377 filed Jun. 28, 2000.

TECHNICAL FIELD

The present invention relates to a firing mechanism at firearms, in particular a firing mechanism at automatic firearms without any preadjustment with regard to firing of a single round or bursts of fire.

The object of the present invention relates to a firing mechanism at firearms, in particular at automatic firearms where the choice of firing single cartridges or automatic fire, respectively, is made during firing by the shot without any mechanical preadjustment or influence of the firing mechanism or trigger.

BACKGROUND OF THE INVENTION

It is previously known different firing mechanisms at firearms, and then in particular automatic firearms, such as submachine guns and automatic carbines, which mechanisms have different types of drawbacks. Thus there are great difficulties firing single rounds using submachine gun m/45. Such single firing of rounds was, and still is, very uncertain, as it is quite common that more than one shot is fired when trying to fire single rounds. The shot simply does not find time to let the trigger go fast enough. The movement of the firing finger will also influence the hitting result in a negative way. The hitting result at double firings is devastating, as it is normal that it is only the first one that hits the target in a correct way. At submachine gun m/45 there is a very simple solution of the firing mechanism, where the spring-loaded trigger with its trigger pin more or less is directly working on the bolt.

At the firing of single rounds using an automatic carbine Ak 4, the shot has to made up his mind already prior to the planning and be aware of the fact that the firing of single rounds is due and thereby preadjust the firearm in accordance with this intention. If a demand for immediate automatic firing will arise during firing, the shot has to adjust the firearm mechanically which prevents attention and intensity of the firing which can be of utmost vital importance.

The problem to be solved is thus to obtain a firing mechanism where the shot himself during firing can influence his choice of firing, viz. firing of single rounds or automatic firing, respectively, while maintaining safety and hit result.

DESCRIPTION OF THE PRESENT INVENTION

It has now surprisingly been shown possible to be able to solve this problem and to obtain a maintenance proof firing mechanism at firearms, in particular automatic firearms, which mechanism is characterized in that a firing link provided with firing edge and arranged around a rotational axis, a lever arm being able to become influenced by the firing edge, which lever arm is present in a spring joint with a lever link, whereby said lever link is present in a spring joint in relation to a sear which carries one or more holding teeth for a bolt.

Further characteristics are evident from the accompanying claims.

By means of the present invention it is possible for the shot, without any mechanical adjustment to choose single round firing or automatic firing from an automatic firearm. Further the present invention guarantees a high degree of safety using two different individual systems, where the last system of the series is decided over by the shot immediately prior to firing.

The present invention will be described more in detail in the following with reference to the attached drawing, which shows an exemplifying embodiment, whereby it shall be noted that the invention is not restricted to this embodiment but there is a great number of varieties which can be present within the scope of the accompanying claims. In the drawing FIG. 1 shows summary perspective view of a firing mechanism in its firing mechanism house;

Figure 1:
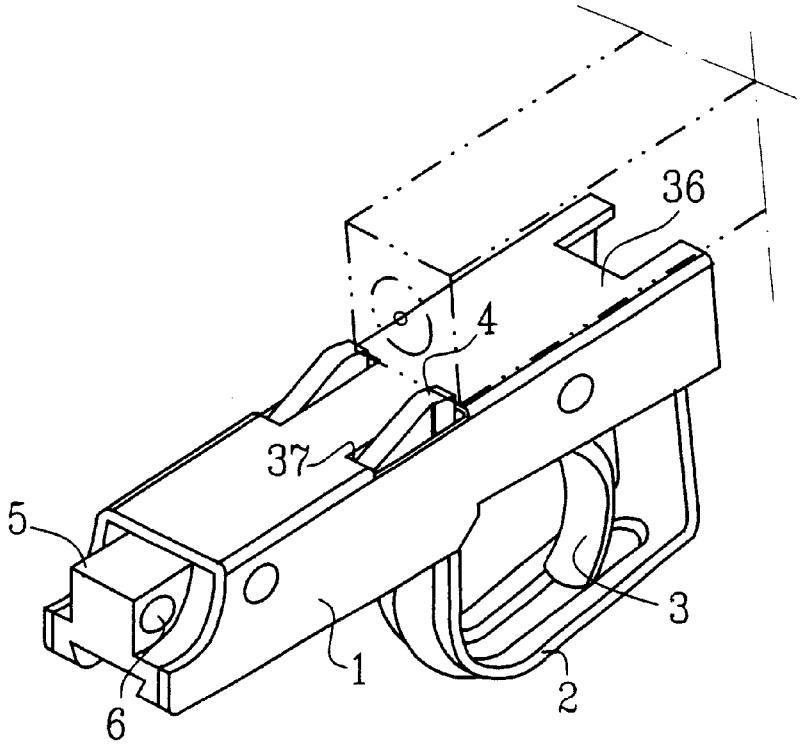
Figure 2:
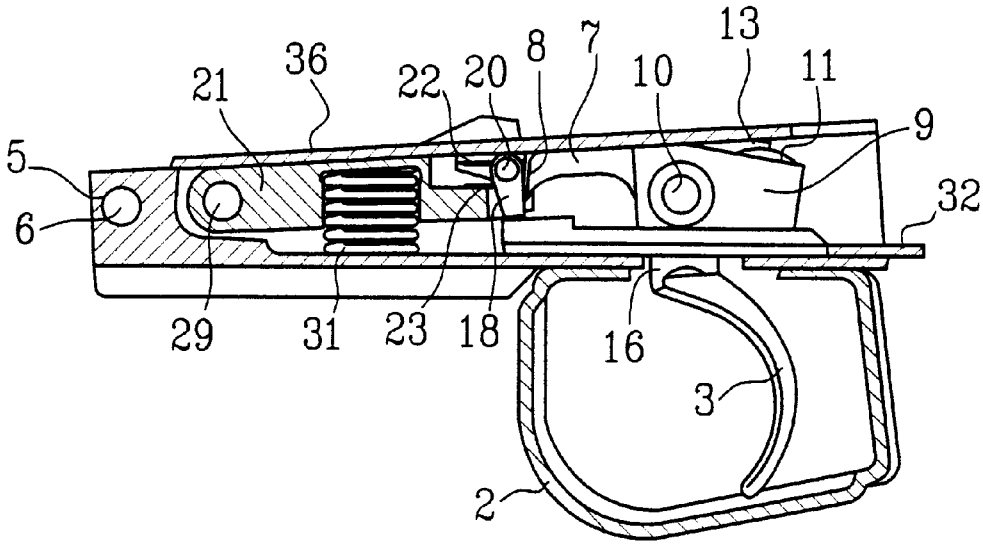
FIG. 2 shows a longitudinal cross-section of the firing mechanism house of FIG. 1 with its firing mechanism.
Figure 3:
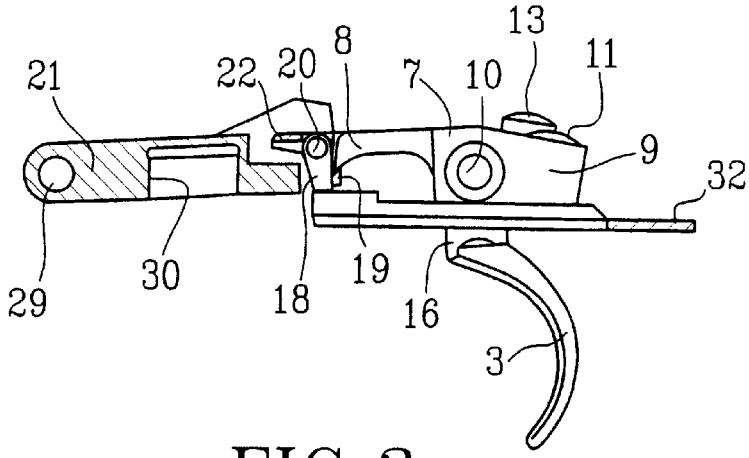
FIG. 3 shows a detailed view of the firing mechanism of FIG. 2.
Figure 4A:
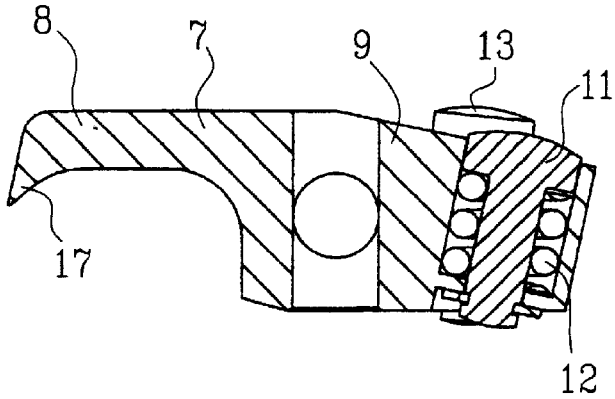
Figure 4B:
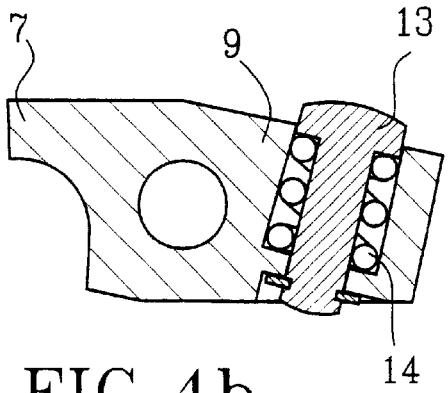
Figure 5:
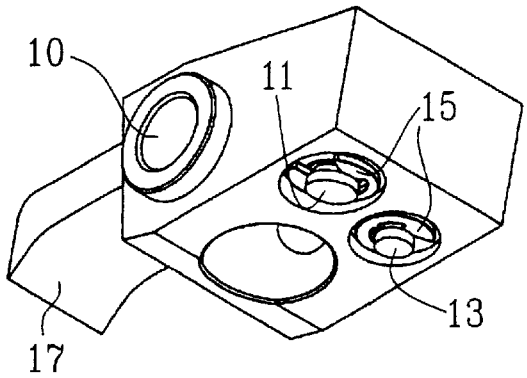
Figure 6:
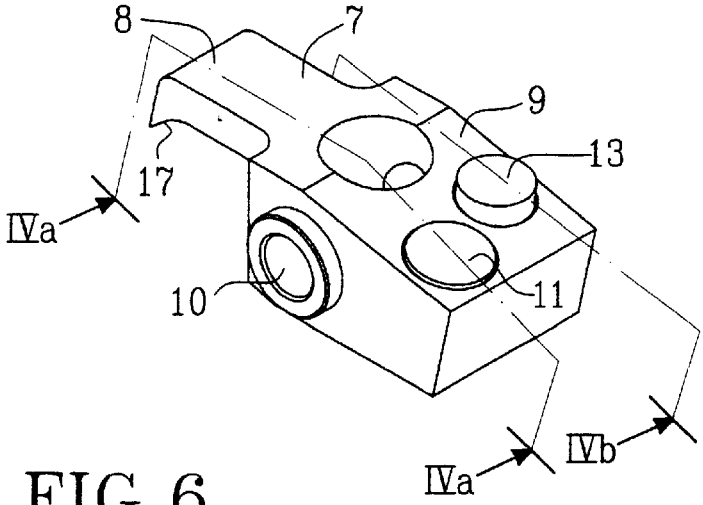
Figure 7:
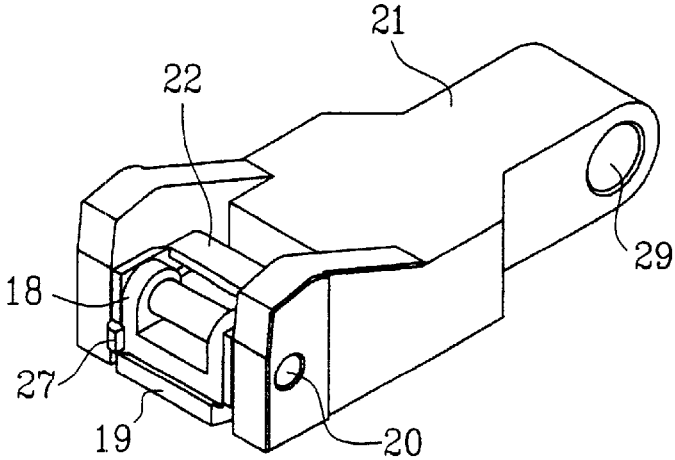
Figure 8:
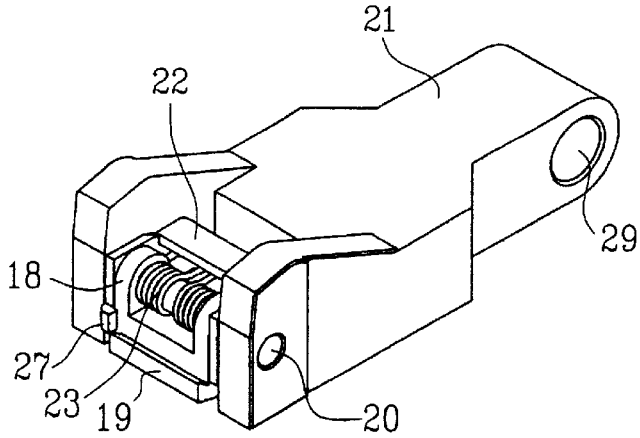
Figure 9:
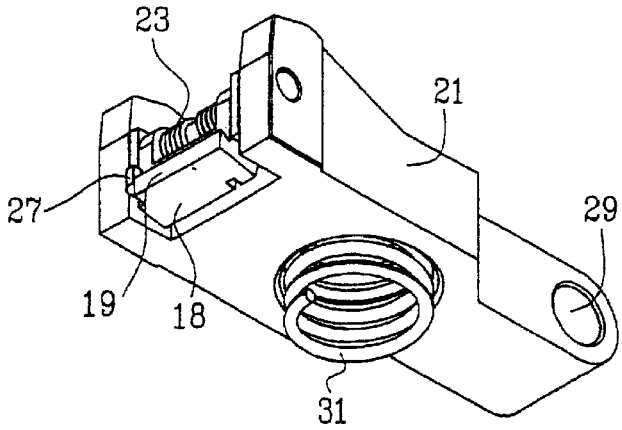
Figure 10:
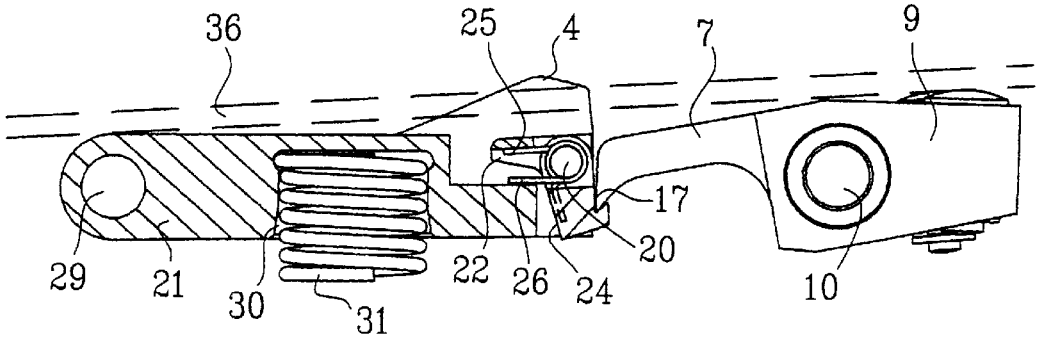
Figure 12:
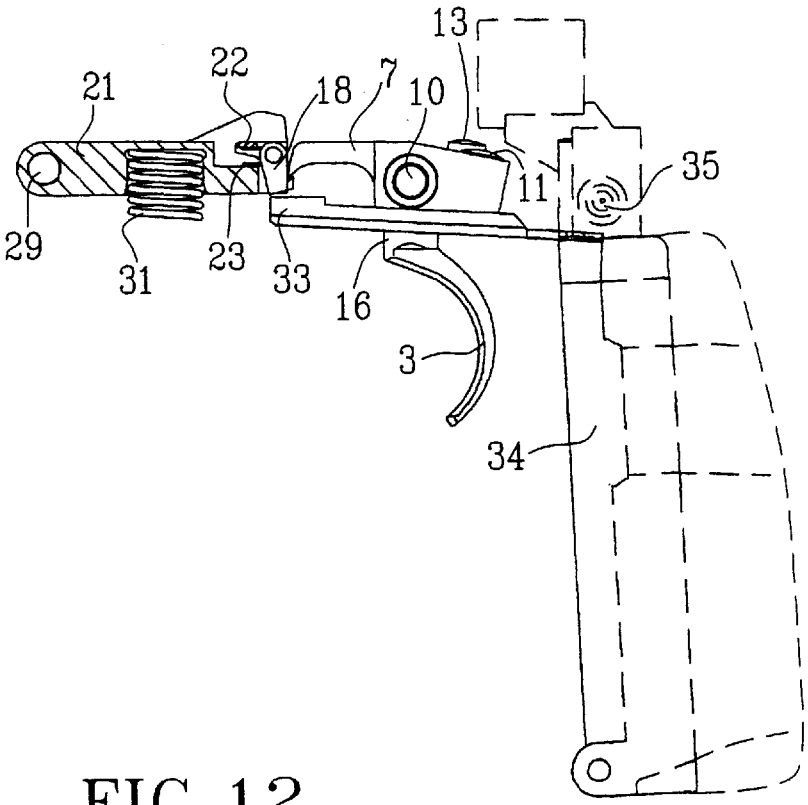
Figure 13:
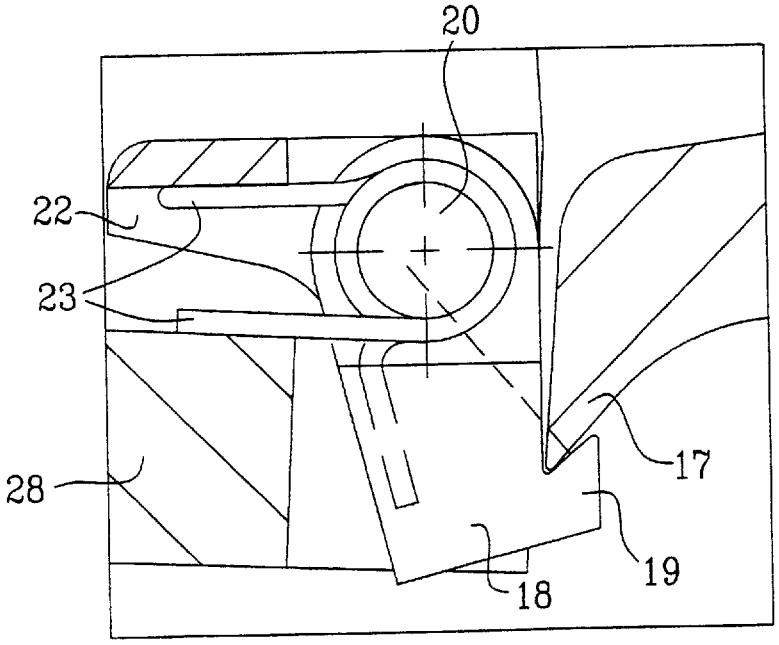

FIGS. 4*a* and 4*b* shows a firing link according to the invention seen from the side in a cross-section;

FIG. 5 shows the firing link of FIG. 4*a* seen from underneath;

FIG. 6 shows the firing link of FIG. 4 *a* seen from above;

FIG. 7 shows a sear with lever arm/lever link in accordance with the invention seen in a perspective view from behind;

FIG. 8 shows the object of FIG. 7 having an in-laid double spring in accordance with the invention;

FIG. 9 shows the sear according to FIG. 7 seen in perspective view from beneath;

FIG. 10 shows a detailed study of the sear of the firing mechanism having lever arm/lever link and firing link, partly in cross-section;

FIGS. 11/1–11/4 shows a firing sequence comprising four part views;

FIG. 12 shows a firing mechanism in accordance with the present invention with its safety details; and FIG. 13 shows firing link and sear in detail.

A firing mechanism in accordance with the present invention is arranged in a firing mechanism house 1, which comprises, in the embodiment shown, a substantially rectangular box, house, provided with a from this downward extending trigger guard 2 arranged to receive a trigger 3. The box is substantially closed on its five sides except for recesses for the trigger 3 and for holding teeth 4 for a bolt (not shown), whereby the box in its front end comprises a firing mechanism house fastening means 5 provided a through-going hole 6 for fastening of the firing mechanism house in firearm (not shown in detail). The firing mechanism will be further described with reference to ingoing components and their joint functions.

A firing link 7 comprises a front firing link 8 placed on a firing link house 9 mounted in the firing mechanism house 1 by means of a firing shaft 10. The firing link house 9 further comprises a substantially vertically arranged position piston 11 which is influenced by a position spring 12, and a returning piston 13 which is influenced by a return spring 14. The lower parts of the position piston 11, and the returning piston 13, respectively, are removably arranged into the firing link 7 by means of two pieces of track riders 15 arranged to run in tracks arranged in the lower part of the respective piston 11, 13. the firing link 7 is, on its underside, provided with a trigger 3. The trigger 3 is, preferably, rotatably mounted in a vertical shaft 16 to the firing link 7 to admit to be able to release the trigger 3 from the firing link 7 at dismounting of the firearm comprising the present firing mechanism and wherein the trigger 3 is present within a trigger guard 2.

The front firing 8 is designed with an edge 17, beak, arranged to grip into a lever arm 18. The lever arm 18, which comprises a rearwardly turned lever arm shoulder 19, is rotatably mounted in a lever arm shaft 20 there is a lever link 22 rotatably mounted. The lever arm 18 and the lever link 22 are mutually influenced by a lever arm spring 23, which either consists of a double spring, or consists of two single springs. The double spring 23 which is mounted around the lever arm shaft 20 as well, an end but 24 which abuts the lever arm 18 in a track arranged herefore, a center protruding 25 of the double spring 23 abuts a shoulder 28 of the sear 21. The mutual movement between the lever arm 18 and lever link 22 is determined by a stop shoulder 27 at the rear side of the lever link 22, which stop shoulder prevents the lever arm 18 to rotate upwardly-rearwardly contra the lever link 22.

The sear 21 is, at its front end, pivotably mounted around a horizontally arranged sear shaft 29. The sear 21 receives at its underside a space 30 arranged to receive a sear spring 31. The rear end of the sear 21, in level with the lever arm 18/lever link 22 one or more holding teeth 4 are arranged on the upper side of the sear 21 for a bolt (not shown).

Underneath the firing link 7 a safety sheet iron 32 is arranged. The safety sheet iron 32 comprises at least a front safety shoulder 33 which at a front position of the safety sheet iron 32 abuts the sear 21 and is there arranged to prevent a rotation downwardly of the sear 21. The safety sheet iron 32 is at its rear end arranged in a holding safety 34 being arranged to a non-shown pistol hold. The safety sheet iron 32 is further arranged to become blocked in a longitudinal movement to a second, rear position of a safety means 35 which is arranged to be moved sideways to and for from a safety position to an unsafety position, whereby the safety sheet iron 32 is released for movement from a forward safe position to a rear, unsafe position.

The firing mechanism comprising firing link 7, sear 21 and lever arm 18 with lever link 22, are, as mentioned above, mounted in a firing mechanism house 1 the roof 36 of which is the bottom of a box above which bottom the underside of the bolt is arranged to run. Through the ceiling/roof 36 of the firing mechanism house 1 the holding teeth 4 of the sear 21 arranged to penetrate through recesses 37 being arranged in said roof 36. The underside of the roof is further a contra surface for the functions of the sear 21 and the firing link 7 and is thus an important part of the function of the firing mechanism. The roof need not necessarily be closed but can consist of different longitudinal and/or cross extending bridges against which the firing mechanism works.

The firing mechanism works in accordance with the following:

In a starting position for firing the bolt (not shown) abuts the holding tooth/teeth 4, the upper side of the firing link 7 abuts the inside of the roof 36 of the firing mechanism house 1, as well as the sear 21 with its lever link 22 (part FIG. 11/1). When the trigger 3 is moved rearwardly, provided the safety means are in unsafe position, the rear end 9 of the firing link 7 is pushed upwardly against the roof 36 of the firing mechanism house 1 while its front edge 17 will press the lever arm 18 downwardly by means its grip in the lever arm shoulder 19 of the lever arm 18 of the of the firing arm 21. The sear 21 is thereby pressed downwardly together with the holding tooth/teeth 4 using the spring 31 of the sear 21 as a contra force. Simultaneously herewith the returning piston 13 is also-pressed into the firing link 7 using its return spring 14 as a contra force (part FIG. 11/2).

The lever arm 19 of the sear 21 still remains around the edge 17 of the firing link 17 and continues to press the sear 21 downwardly until the holding tooth/teeth 4 have been pressed so far down that the bolt is released by a spring or in any other the sear 21 is pressed further down into the firing mechanism house 1. The firing link 7 will now within short release its grip in the lever arm shoulder 19 as the firing link 7 is not pressed further down due to the resistance of the position piston 11 with its position spring 12, whereby the lever arm 18 and the lever link 22 due to the double spring 23 will be turned forward-upwardly (part FIG. 11/4) to some extent due to the stop shoulder 27. If the trigger 3 should be released in this position the edge 17 of the firing link 7 will be pressed upward by means of the spring 14 of the returning piston 13, whereby the lever arm shoulder 19 again is caught by the edge 17 of the firing link 17 when the sear 21 is pressed upward by its spring and the lever link 22 meets the roof 36 of the firing mechanism house 1 and throw the lever arm 18 rearwardly by means of the spring 23.

At firing of single rounds the shot feels the position when the position piston 11 hits the roof 36 of the firing mechanism house 1 and the pressure obtained by means of the position spring 12, whereby a concise position is at hand.

At automatic firing the trigger 3 is drawn backward in one moment so that both the returning piston 13 with its return spring 14 and the position piston 11 with its position spring 12 are pressed down into the firing link house 9 of the firing link 7. Hereby the forward movement of the bolt will not influence a release of the lever arm shoulder 19 from the edge 17 of the firing link 7 but these are kept into grip with each other, whereby the sear 21 with the holding tooth/teeth 4 of the bolt can not move upward (art picture 11/3). Automatic firing continues as long as the trigger 3 thereby is kept withdrawn, or until the magazine with its rounds has been emptied.

What is claimed is:

1. A firing mechanism for firing without preadjustment with regard to the choice of firing single rounds or bursts of fire, said firing mechanism comprising a firing link that is provided with a firing edge and arranged around a rotational axis, a lever arm being able to become influenced by the firing edge, wherein said lever arm is coupled with a lever link using a first spring device, whereby said lever link is coupled in relation to a sear using said first spring device, said sear carries one or more holding teeth for a bolt, whereby the lever arm and the lever link are arranged around a further rotation axis.

2. A firing mechanism according to claim 1, wherein the firing link, lever link and sear are arranged to function against a contra surface.

3. A firing mechanism according to claim 1, wherein the first spring device between the lever arm and lever link is a double spring.

4. A firing mechanism according to claim 1, wherein the firing link in its rear part receives a returning piston with its return spring.

5. A firing mechanism according to claim 1, wherein the firing link in its rear part receives a position piston with its position spring.

6. A firing mechanism according to claim 1, wherein the sear on its underside receives a sear spring.

7. A firing mechanism according to claim 1, further comprising a trigger that is rotatably arranged in a vertical position to the firing link so that that the trigger is able to release from the firing link.

8. A firing mechanism according to claim 1, wherein a safety sheet iron is arranged to block a rotation of the sear in a front position, and arranged to admit rotation of the sear in a rear position.

9. A firing mechanism according to claim 1, further comprising a safety sheet iron that is arranged to be influenced by a hold safe.

* * * * *